US007946754B2

(12) United States Patent
Perret et al.

(10) Patent No.: US 7,946,754 B2
(45) Date of Patent: May 24, 2011

(54) CLOCKWORK MOVEMENT

(75) Inventors: Laurent Perret, La Chaux-de-Fonds (CH); Francois Trifoni, Le Locle (CH); Stephen Forsey, Les Brenets (CH)

(73) Assignee: CompliTime SA, La-Chaux-de-Fonds (CH)

( * ) Notice: Subject to any disclaimer, the term of this patent is extended or adjusted under 35 U.S.C. 154(b) by 229 days.

(21) Appl. No.: 12/094,890

(22) PCT Filed: Nov. 21, 2006

(86) PCT No.: PCT/EP2006/068692

§ 371 (c)(1),
(2), (4) Date: May 23, 2008

(87) PCT Pub. No.: WO2007/060150

PCT Pub. Date: May 31, 2007

(65) Prior Publication Data

US 2008/0298178 A1 Dec. 4, 2008

(30) Foreign Application Priority Data

Nov. 24, 2005 (EP) ..... 05111266

(51) Int. Cl.
*G04F 7/00* (2006.01)

(52) U.S. Cl. ..... 368/101; 368/103

(58) Field of Classification Search ..... 368/74, 368/101–106

See application file for complete search history.

(56) References Cited

U.S. PATENT DOCUMENTS

| | | | | |
|---|---|---|---|---|
| 383,749 | A * | 5/1888 | Meylan | 368/102 |
| 2,325,539 | A | 8/1940 | Pfister | |
| 4,127,985 | A * | 12/1978 | Murrle | 368/35 |
| 7,014,356 | B2 * | 3/2006 | Bobe et al. | 368/102 |
| 7,065,005 | B2 | 6/2006 | Rochat | |
| 7,275,860 | B2 * | 10/2007 | Hirano et al. | 368/191 |

FOREIGN PATENT DOCUMENTS

| | | | |
|---|---|---|---|
| CH | 6505 | A | 11/1893 |
| DE | 89768 | C | 12/1896 |
| EP | 1 394 637 | A1 | 3/2004 |

OTHER PUBLICATIONS

International Search Resort dated Dec. 7, 2007.
International Search Report dated Jul. 12, 2007 from PCT/EP2006/068692.

* cited by examiner

*Primary Examiner* — Sean Kayes
(74) *Attorney, Agent, or Firm* — Young & Thompson

(57) ABSTRACT

A clockwork movement includes a control member actuatable by a control lever in response to a user's action and having the form of a column wheel. The control member is rotatably mounted on the clockwork movement frame around an axis X, perpendicular thereto, for controlling first and second mechanisms exhibiting at least one movement function such as chronograph or alarm function. The control member includes rotationally fixable first, second and third parts which are mounted on a shaft at first, second and third levels, respectively, in a direction of the axis X for interacting with the control lever and for controlling the mechanisms. The shaft which is pivotally mounted with respect to the frame is arranged in at least two bearings, which are positioned remotely to each other for ensuring the shaft good stability, whereas the second and third parts are located on the both parts of the frame.

8 Claims, 3 Drawing Sheets

CLOCKWORK MOVEMENT

TECHNICAL FIELD

The present invention relates to a clockwork movement comprising a frame defining a reference plane, a control lever mobile on the frame and designed to be moved, in response to a user's action, to act on a control member of the movement. This control member is rotatably mounted on the frame around an axis X which is perpendicular to the reference plane for controlling first and second mechanisms exhibiting at least one movement function. For this purpose, the control member comprises first, second and third parts mounted at first, second and third levels, respectively, in a direction of the axis X, for interacting with the control lever and controlling the mechanisms, these three parts being integral in rotation.

One preferred embodiment of the invention concerns a movement of this type wherein the movement control member is a column wheel, and the movement function controlled by the column wheel can be a chronograph function, for information.

STATE OF THE ART

Many clockwork movements with chronograph functions whereof the control member is a cam are known from the state of the art. Likewise, many movements with chronograph functions in which the control member is a column wheel are known.

Furthermore, the use of a control member of this type to activate or deactivate other functions other than a chronograph is also known from the prior art. For example, patent application EP 1 394 637, in the name of Frédéric Piguet SA, describes a clockwork movement provided with an alarm mechanism in which the operating state of the alarm is controlled by a traditional column wheel.

The construction and assembly of the column wheel described in this document are traditional and also correspond to those implemented for the cam systems. This column wheel comprises drive means implemented in the form of a ratchet, as well as control means implemented in the form of a ring wherein columns are cut. The column wheel is engaged, via its central hole, on a hollow post integral with the plate wherein a stepped screw is screwed. Thus, the column wheel is free to rotate in relation to the post while the head of the stepped screw ensures its axial maintenance.

The primary advantages of a column wheel reside in its ability to simultaneously and precisely control the movements of several mobile elements of the movement, while also demonstrating great structural simplicity.

However, when it controls the movement of certain mobile elements of the movement, the column wheel must rotate while generally overcoming the force of one or several springs acting on these mobile elements. Moreover, its angular positioning is typically ensured by a jumper, which has a significant stiffness, the force of which it must also overcome before being able to rotate by one pitch.

All of these constraints can, over time, be harmful for the precision of the positioning of the column wheel and its rotational movements, in particular when they are not distributed around the axis of rotation of the wheel in a well-balanced way. Furthermore, the implementation of assembly means of the column wheel is relatively complex and requires extreme meticulousness, in particular for positioning of the hole in the plate to house the post, the dimensioning of the post and that of the central hole of the column wheel.

Solutions have been proposed which meet the definition mentioned above, and in which the column wheel comprises an arbor having an axis X, bearing the first, second and third parts, the arbor being rotatably mounted in at least two bearings of the frame placed apart from each other.

U.S. Pat. No. 2,325,539, issued Jul. 27, 1943 in the name of Société Industrielle de Sonceboz SA, describes a chronograph movement comprising a control member including an arbor mounted on a frame of the movement and supporting three control cams integral in rotation. Each of the cams is arranged to control a specific mechanism associated with the chronograph function. However, the presented structure is relatively bulky and has little flexibility in the arrangement of the components of the movement.

Patent CH 6505, issued Apr. 12, 1893 in the name of P. Perret and P. Jeannot, describes a chronograph movement comprising a control member having three parts distributed on three different levels and rotatably mounted on the frame of the movement by a single bearing. This mechanism is less bulky than the preceding one, but hardly offers more flexibility in the arrangement of the different mechanisms controlled by the rotating member.

BRIEF SUMMARY OF THE INVENTION

The primary objectives of the present invention are to improve the operating precision, the reliability, and the preservation, over time and with wear, of the movements of the prior art, while also offering the movement's designer great flexibility in the arrangement of the different mechanisms necessary for the operation of the movement.

To this end, the present invention relates to a clockwork movement of the type mentioned above, characterized by the fact that the second and third parts are arranged on both sides of at least one frame element.

Thanks to this characteristic, the various mechanisms controlled from the rotating control member can be distributed in the movement by the designer according to the designer's needs, in order to optimize the bulk of the movement without damaging its quality.

In the continuation of this text, the term "bearing" must be interpreted in a functional sense, i.e. as being able to be implemented in any suitable form to present substantially cylindrical and flat bearing surfaces, respectively, able to provide radial and/or axial guiding of a rotatable element.

Thanks to the fact that the arbor whereon the control member pivots is mounted on two bearings, the stresses undergone by said shaft can be better distributed and its rotational precision becomes better. These characteristics contribute notably to the reduced wear of the control member over time.

Preferably, the two bearings are arranged on both sides of the assembly formed by the first, second and third parts, which makes it possible to better improve the stability of the arbor in relation to the frame of the movement. More precisely, this preferred embodiment makes it possible to eliminate the cantilever situation in which the first and second parts are found in certain configurations of the prior art. Moreover, the first and second parts, providing the functions of drive means and control means, respectively, are preferably integral with the arbor in rotation.

In one specific embodiment, the arbor of the rotating control member is provided with a square onto which a sleeve bearing the third part intended to control the second mechanism of the movement is engaged.

BRIEF DESCRIPTION OF THE DRAWINGS

Other characteristics and advantages of the invention will appear more clearly upon reading the following detailed description, done in reference to the appended drawings presented as non-limiting examples and in which.

DETAILED DESCRIPTION OF THE DRAWINGS

Figure 1A:
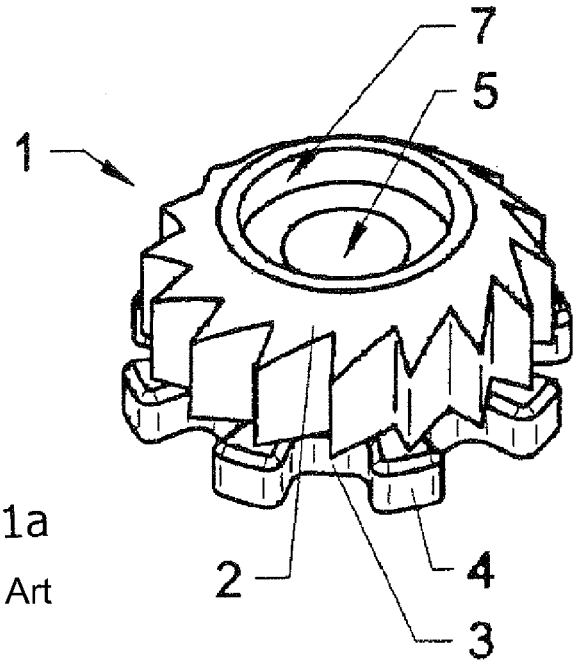
Fig. 1a Prior Art
FIG. 1*a* shows a perspective view of a control member whereof the structure of the pivot means is similar to the structures known from the prior art.
Figure 1B:
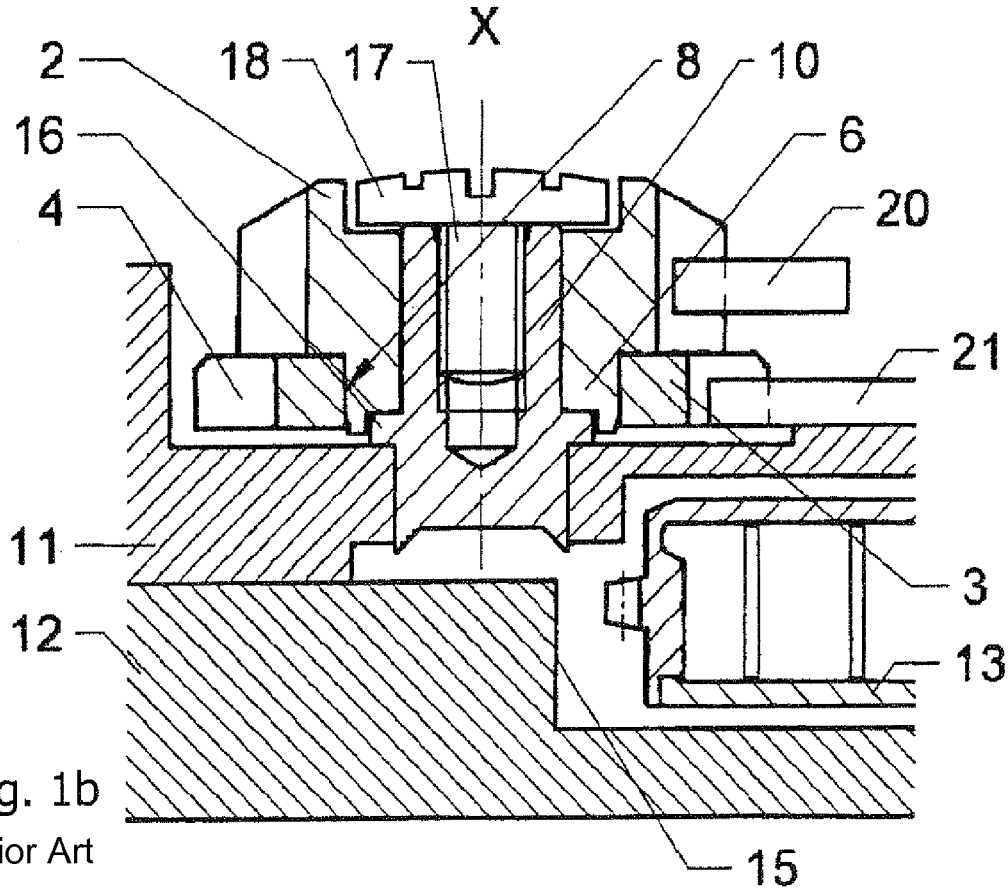
Fig. 1b Prior Art
FIG. 1*b* shows a transverse cross-section of the control member of FIG. 1*a* when it is placed on a frame of a clockwork movement.

FIGS. 1*a* and 1*b* show a specific control member, namely a column wheel 1 having a structure of the type known in the prior art, in an elevation view and a cross-sectional view, respectively.

This column wheel has two parts, a ratchet 2 and a disc 3 bearing columns 4, made integral with each other through a conventional riveting or molding process, for example. One also finds column wheels made in a single piece, i.e. in the form of a toothed wheel provided with columns perpendicular to this wheel.

The ratchet 2 is made here in the form of a ring comprising a cylindrical central hole 5, and comprising a bush 6 on one of its surfaces. The ratchet also comprises a cylindrical recess 7 coaxial to the hole 5, arranged in the other surface of the ring and having a diameter larger than that of the hole. The disc 3 bearing the columns also has a central hole 8 through which it is engaged on the bush 6 of the ratchet 2.

The column wheel 1 is mounted on a cylindrical and hollow post 10, itself press-fitted or riveted in a frame element of a clockwork movement. In FIG. 1*b* we have shown the positioning of the post 10 on a chronograph bar 11 mounted integral with the plate 12 of the movement.

We have also distinguished a barrel part 13 housed in a recess 15 of the plate in this figure.

The post 10 has a radial banking 16 to ensure its axial positioning relative to the chronograph bar 11, and also defining a bearing surface for the bush 6 of the column wheel when it is put into place.

A large-head screw 17 is screwed into the post until its head 18 is arranged abutting against the free end of the latter. The head 18 of the screw 17 is then engaged inside the recess 7 of the ratchet 2 and ensures the axial maintenance thereof on the post such that the column wheel is free to rotate.

The end of a control hook 20 is shown between two teeth of the ratchet 2. Conventionally, the control hook is borne by a mobile control lever (not shown) whereof the movements are caused by actuation of an outside control member, generally a push button, of a watch case in which the movement is mounted. Thus, each pressure exerted on this outside control member drives the rotation of the column wheel by one half-pitch. The angular positioning of the column wheel is typically guaranteed through the use of a jumper (not shown). Of course, any other suitable control member can be used alternatively, without going outside the framework of the present invention.

The columns 4 are driven in rotation simultaneously with the rotational movement of the ratchet 2 and acting on the end 21 of a yoke, such as a coupling yoke for example, kept in contact with the column wheel through the action of a spring (not shown). When the column wheel rotates, in response to repeated actuations on the outside control member, the end 21 of the yoke is alternatively found between two columns 4 and on one specific column, which has the effect of causing it to oscillate around its pivot axis in order to act on a mechanism of the movement for minutes and seconds. For information, the movements of a conventional coupling yoke enable successive couplings and uncouplings of a wheel driving a chronograph with a chronograph train.

The chronograph movement commonly comprises at least one return-to-zero hammer also laid out so as to have a part arranged bearing against the column wheel under the effect of a hammer spring. Likewise, as already mentioned above, the angular positioning of the column wheel relative to the plate is ensured by a column wheel jumper exerting pressure simultaneously on two successive teeth of the ratchet.

The combined action of the springs and the control hook can be damaging to the precision of the positioning and the rotational movements of the column wheel, in particular with use. More precisely, the fact that only a small portion of the post 10 is integral with the frame while its biggest portion, arranged in cantilever, must ensure the positioning of the column wheel, harms the stability of the entire mechanism over time.

The present invention aims to resolve these drawbacks by proposing in particular a control member whereof the positioning is more precise and the rotational movements of which are better balanced, because it is borne by an arbor mounted on two pivots arranged apart from each other in the frame of the movement.

Figure 2:
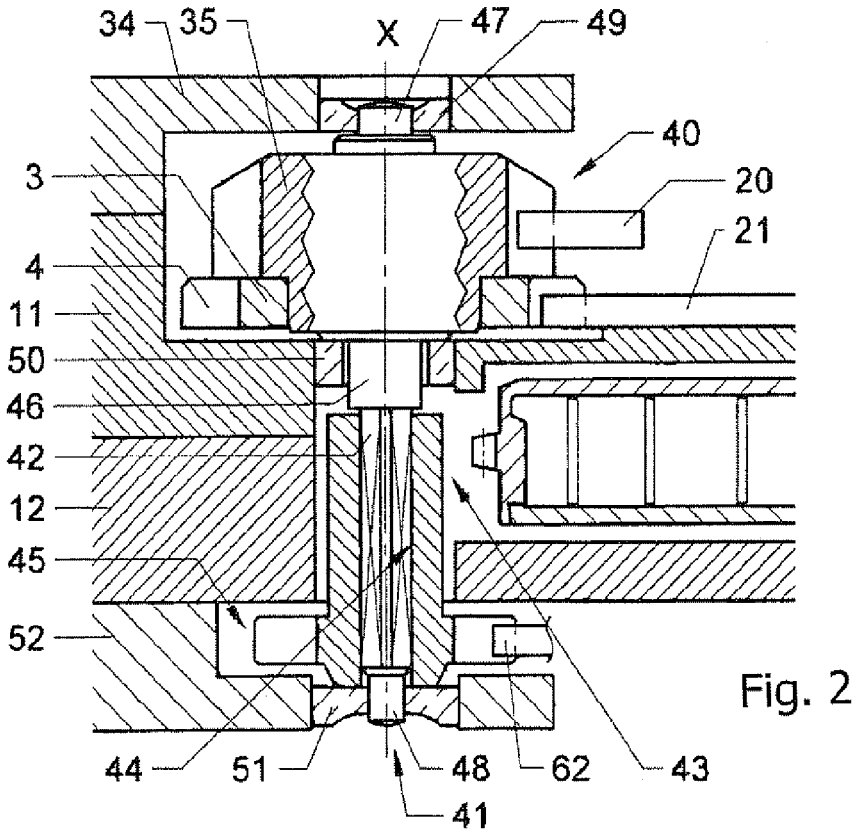
FIG. 2 shows a partial cross-section of a control member of the same type as that of FIGS. 1*a* and 1*b*, according to a first embodiment of the present invention.

FIG. 2 shows a partial cross-sectional view, similar to the cross-sectional view of FIG. 1*b*, of a column wheel according to a first embodiment of the present invention.

In general, the column wheel is located on the bar side of the plate of the movement. Insofar as the column wheel according to the present invention comprises an arbor extending on both sides of the plate, the end of the arbor located on the dial side of the plate can be provided with additional control means.

To this end, the column wheel 40 has three parts serving respective functions relative to other mobile elements of the movement. The first part, i.e. the ratchet 35, enables rotational driving of the wheel in response to an action by a user. The second part, a control part, i.e. the columns 4, makes it possible to retransmit the rotational movement from the column wheel 40 to a mechanism of the movement associated with a specific function, such as a chronograph mechanism, for example. The column wheel 40 has a third part, a control part, making it possible to retransmit the rotational movement from the column wheel to an additional mechanism.

To bear the third part, the arbor 41 of the column wheel 40 has a square 42 on its primary portion. The third part comprises an elongated and hollow sleeve 43 whereof the central hole 44 has a shape adapted to keep the sleeve in rotation with the square of the column wheel. The sleeve bears a star 45 (more visible in FIG. 4), preferably made in a single piece with the sleeve and arranged on the side of the end of the arbor 41.

This arbor 41 also comprises a central region 46 and two end portions 47 and 48 rotatably mounted in bearings integral with the frame, shown here in the form of stones of the conventional type.

A first bearing 49 is housed in the column wheel bar 34 while a second bearing 50 is housed in the chronograph bar 11, and a third bearing 51 is housed in an additional bar 52, integral with the plate 12 from its dial side.

The column wheel 40, as such, is arranged between the first and second bearings 49, 50, while the sleeve 43 is arranged between the second and third bearings 50, 51.

Thanks to this structure, in particular due to the distance separating the two bearings 49, 51 from each other, the positioning of the arbor and therefore the positioning of the column wheel have great precision. Moreover, the stability of the column wheel is guaranteed, as is its preservation over time.

In the illustrated embodiment, it is important to note that the abovementioned advantages are optimized by an arrangement of the two bearings on either side of the assembly formed by the ratchet and the columns. An arrangement of this type, without being limiting, indeed makes it possible to guarantee better absorption of the stresses applied both on the ratchet and on the columns through the elimination of the cantilever configuration of the latter elements, as explained above.

It appears from FIG. 2 that the first bearing 49 interacts with the first end portion 47 to provide both radial and axial maintenance of the arbor 41 and, as a result, of the column wheel 40. The second bearing 50 acts on the column wheel 40 to provide its maintenance in the axial direction, in particular to limit the amplitude of its movements in this direction. The third bearing 51 cooperates with the second end portion 48 to provide radial maintenance of the arbor 41, this function being accentuated by the relatively significant distance separating the third bearing 51 from the first bearing 49.

One may also note that the sleeve 43 is positioned in the axial direction, on one hand, via the central region 46 of the arbor 41 defining a first banking for the sleeve and, on the other hand, via the third bearing 51 against which it rests in the illustrated configuration.

Preferably, but not exhaustively, the arbor 41 forms a single piece with the ratchet 35 of the column wheel, while the disc 3 bearing the columns 4 is press-fitted or riveted to the ratchet 35, similarly to what was described in relation with FIGS. 1*a* and 1*b*.

It is shown by the preceding description that the sleeve 43 and, with it, the star 45 are driven in rotation simultaneously with the arbor 41 and, with it, the column wheel 40. These rotational movements, controlled by the user's actions, can advantageously be taken advantage of to control an additional mechanism of the movement.

Figure 3:
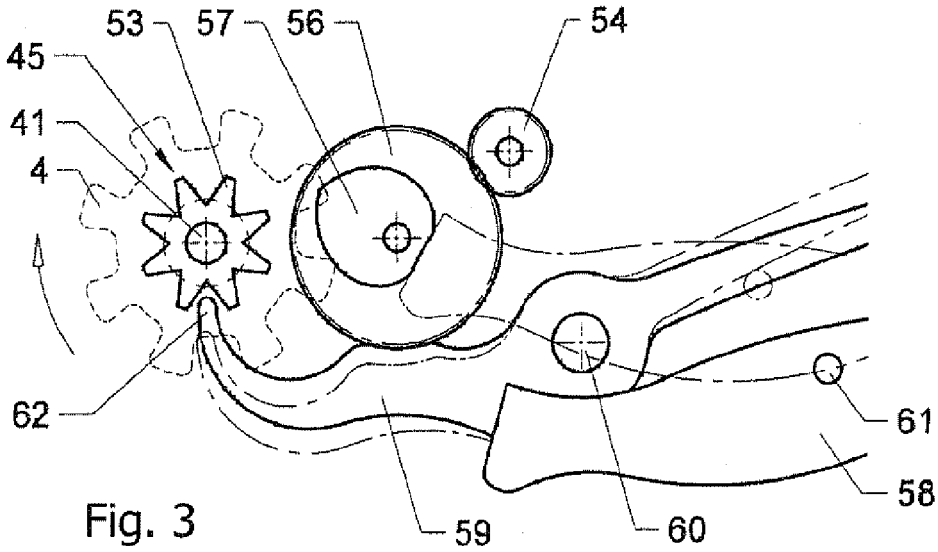
FIG. 3 shows a top view of a detail of the control member of FIG. 2 having the function of additional control means in a clockwork movement of the chronograph type.

FIG. 3 shows an example of one such mechanism, in a preferred embodiment of the movement according to the present invention.

This figure shows a simplified elevation view of certain component elements of an hour counter mechanism, located on the dial side, in a movement having a chronograph function.

The star 45 is shown with eight branches 53, i.e. as many branches as columns 4 showing through (dotted lines) in FIG. 3, the position of the branches being indexed on that of the columns.

An intermediate wheel 54, typically driven from the barrel, drives the wheel 56 of an hour counter bearing a hand indicating timed hours (not visible). The hour counter bears a conventional return-to-zero heart-piece 57 designed to be driven in rotation by a return-to-zero hammer 58 of the hour counter, in response to a user's action on an outside return-to-zero member.

The return-to-zero hammer 58 is shown in its rest position, in solid lines, when it is separated from the heart piece 57, and in its lowered position in mixed lines, in which it bears against the heart-piece 57, the latter thus being in its position ensuring that the hand indicating timed hours is kept at zero.

A brake-lever 59, pivotably mounted on the plate through a post 60, makes it possible to maintain the position of the hour counter when the hammer 58 is in its rest position and a time measurement is not in progress. Conventional friction is provided to allow the immobilization of the wheel 56 of the hour counter in relation to the intermediate wheels, during stops of the chronograph function or during return-to-zero operations.

The hammer 58 bears a pin 61 arranged to cooperate with the brake-lever during return-to-zero operations. When the hammer is actuated and if it moves in the direction of the heart-piece 57, the pin 61 exerts pressure on the brake-lever, in a known manner, to cause it to pivot so as to release the wheel 56 of the hour counter and allow the return to zero. The brake-lever is shown in mixed lines in FIG. 3 when the hammer 58 is lowered against the heart-piece 57.

Moreover, the brake-lever 59 comprises a beak 62 located in the region of the star 45 to cooperate with its branches 53, during rotational movements of the column wheel 40.

The hour counter mechanism is shown in its stopped position in FIG. 3, the brake-lever 59 bearing against the wheel 56. When the user actuates an outside control member to engage the start of the chronograph function, the column wheel 40 is driven in rotation by one half-pitch, the columns 4 acting on the yoke 21 to activate a chronograph mechanism. In the same time, the star 45 performs a rotation of one half-pitch and the beak 62 of the brake-lever is pushed back by an arm 53, to be separated from the wheel 56 of the hour counter. Said wheel 56 can then be driven to indicate the hours measured. When the user actuates the outside control member again, the column wheel 40 completes a new rotation of one half-pitch and the beak 62 is then found across from a space between two arms 53. As a result, the brake-lever 59 is pushed back in the direction of the wheel 56 of the hour counter by a conventional spring (not shown) to stop its rotation.

At this stage, the time measurement may be restarted by a new action of the user on the outside control member, then stopped in the same way, an indefinite number of times. When the chronograph function is interrupted, a return to zero may be done, as previously described.

Figure 4:
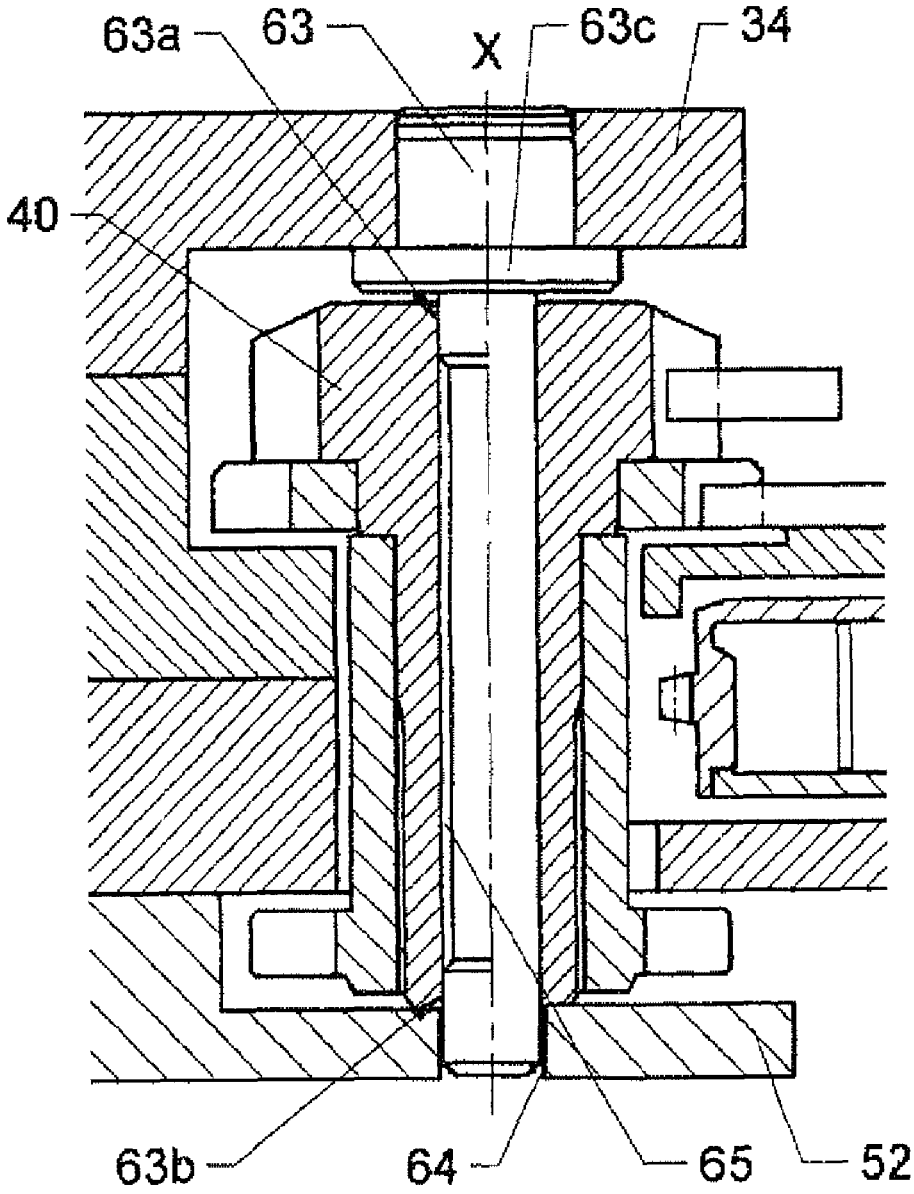
FIG. 4 shows a partial cross-section, similar to that of FIG. 2, of a control member according to a second embodiment of the present invention.

In the control member shown in FIG. 4, the column wheel bar 34 is provided with a press-fitted cylindrical rod 63, engaged in a hole 64 of the bar 52, without play, such that it is kept at its two ends. The diameter of the rod 63 is slightly larger than these two ends 63*a* and 63*b*. The column wheel 40 is pierced in its center and over its entire length, with a cylindrical hole 65 serving as a housing for the rod 63. The column wheel 40 is thus radially positioned by the ends 63*a* and 63*b* of the rod 63. Axial positioning is ensured, from the bar side 34 by a shoulder 63*c* comprised by the rod 63, and from the other side by the bar 52. The column wheel 40 can therefore rotate freely on the rod 63, with perfectly controlled axial and lateral plays. Thus, the rod 63 and the bar 52 form, together, two bearings ensuring the pivoting of the column wheel 40.

It clearly appears that the structure of the movement according to the present invention has an increased simplicity relative to the movements of this type known from the prior art. In particular, the chronograph movements of the state of the art in which an hour counter is provided, the mechanism of this hour counter being arranged from the dial side of the plate, require that one provide for a greater number of elements to ensure the control of this mechanism.

Moreover, as already mentioned, due to the fact that the maintenance of the column wheel 40 is, here, ensured by a plurality of bearings, radial maintenance in particular being guaranteed by two bearings separated from each other, the activation of the mechanisms in response to a user's action is done with great reliability.

The preceding description corresponds to preferred embodiments described non-exhaustively, in particular with regard to the forms shown and described for the ratchet or the columns. One can in particular provide that the ratchet is made up of a piece attached on the arbor of the column wheel, means being implemented to make these two elements integral with each other in rotation. With regard to the sleeve, one can imagine any other suitable form for controlling a mechanism. Alternatively to the embodiment shown in FIG. 2, one can omit the intermediate bearing 50 and/or the columns 4, the corresponding control member in this case only comprising the star 45 to control a single movement mechanism, without going outside the framework of the present invention.

One can provide, as an alternative to the design with a sleeve, that the plate comprises a lateral opening to allow the insertion of the control member in its site.

It is, of course, also possible to apply the principles described to a control member of the cam type, also called a shuttle.

Moreover, the function of the movement can be something other than the chronograph function. In reference to the above-mentioned application EP 1 394 637 of the prior art, one can implement the present invention in a clockwork movement comprising an alarm function. In this case, the column wheel can be used as described in the abovementioned application while the third part of the column wheel according to the present invention, located on the dial side of the plate, is taken advantage of to control a mechanism indicating the operating state of the alarm, through a yoke system, for example.

The invention claimed is:

1. A timepiece movement comprising a frame defining a reference plane, a control lever mobile on said frame and designed to be moved, in response to a user's action, in order to drive the rotation of a control member, said control member controlling first and second mechanisms providing at least one movement function, rotatably mounted on said frame around an axis X which is perpendicular to the reference plane and comprising first, second and third parts arranged at first, second and third levels, respectively, in the direction of said axis X, to be driven in rotation by said control lever and to control said first and second mechanisms, said parts being integral in rotation, said first, second and third parts rotate simultaneously controlled by actions on the control lever, one of said first and second parts comprising a plurality of columns, said control member comprising an arbor having an axis X bearing said parts and mounted pivotably in at least two bearings of said frame arranged apart from each other, wherein said second and third parts are arranged on either side of at least one element of said frame.

2. The movement according to claim 1, wherein said arbor has a square on which a sleeve bearing said third part is engaged.

3. The movement according to claim 2, wherein said bearings are arranged on either side of the assembly formed by said first, second and third parts.

4. The movement according to claim 1, wherein said bearings are arranged on either side of the assembly formed by said first, second and third parts.

5. The movement according to claim 1, wherein said first and second parts are mounted on said arbor and are integral in rotation with this arbor.

6. The movement according to claim 1, wherein said control member is a column wheel, said first part comprising a ratchet and said second part comprising a plurality of columns.

7. The movement according to claim 6, when the movement is of the chronograph type, wherein said first mechanism comprises control mechanisms for seconds and minutes arranged on a first side of a plate, said second mechanism comprising control mechanisms for an hour counter arranged on a second side of said plate.

8. The movement according to claim 7, wherein said second mechanism comprises a star whereof the number of arms is equal to the number of columns of said column wheel.

* * * * *